US007465356B2

(12) United States Patent
Rudolph et al.

(10) Patent No.: US 7,465,356 B2
(45) Date of Patent: Dec. 16, 2008

(54) DEVICE AND METHOD FOR COATING MATERIAL

(75) Inventors: Heinfried Rudolph, Osterode (DE); Jorg Heinemann, Osterode (DE)

(73) Assignee: Kodak Graphic Communications Canada Company, Burnaby, British Columbia (CA)

( * ) Notice: Subject to any disclaimer, the term of this patent is extended or adjusted under 35 U.S.C. 154(b) by 112 days.

(21) Appl. No.: 10/564,138

(22) PCT Filed: Jul. 16, 2004

(86) PCT No.: PCT/EP2004/007972

§ 371 (c)(1),
(2), (4) Date: Jan. 10, 2006

(87) PCT Pub. No.: WO2005/014181

PCT Pub. Date: Feb. 17, 2005

(65) Prior Publication Data

US 2006/0165902 A1 Jul. 27, 2006

(30) Foreign Application Priority Data

Jul. 21, 2003 (DE) ..... 103 33 121

(51) Int. Cl.
*B05C 3/02* (2006.01)

(52) U.S. Cl. ..... 118/410; 425/466

(58) Field of Classification Search ..... 118/410, 118/DIG. 2, 325; 425/466, 461, 382.4; 427/284, 427/285, 286
See application file for complete search history.

(56) References Cited

U.S. PATENT DOCUMENTS

| | | | | |
|---|---|---|---|---|
| 4,272,312 | A * | 6/1981 | Thompson | 156/244.11 |
| 4,348,346 | A * | 9/1982 | Thompson | 264/146 |
| 5,451,357 | A * | 9/1995 | Cloeren | 264/173.16 |
| 5,575,851 | A * | 11/1996 | Abe et al. | 118/410 |

FOREIGN PATENT DOCUMENTS

| | | |
|---|---|---|
| DE | 1 023 949 | 1/2004 |
| GB | 1 508 198 | 4/1978 |
| JP | 06114317 | 4/1994 |
| JP | 10005663 | 1/1998 |

* cited by examiner

*Primary Examiner*—Brenda A. Lamb
(74) *Attorney, Agent, or Firm*—J. Lanny Tucker

(57) ABSTRACT

The present invention relates to a device and a method for coating preferably webs or strip-like material and in particular to a method and a device for adapting the coating width of such devices. In particular, the present invention moreover relates to the field of liquid coatings by means of slot coating systems. The present invention provides a device and a method in which the coating width is adaptable via limiting means that are movable relative to each other. According to an additional or further preferred embodiment of the invention, the coating width is limited by means of a confining fluid. Preferably, a continuous material web is simulated by means of the confining fluid in the edge area.

6 Claims, 2 Drawing Sheets

Figure 1:
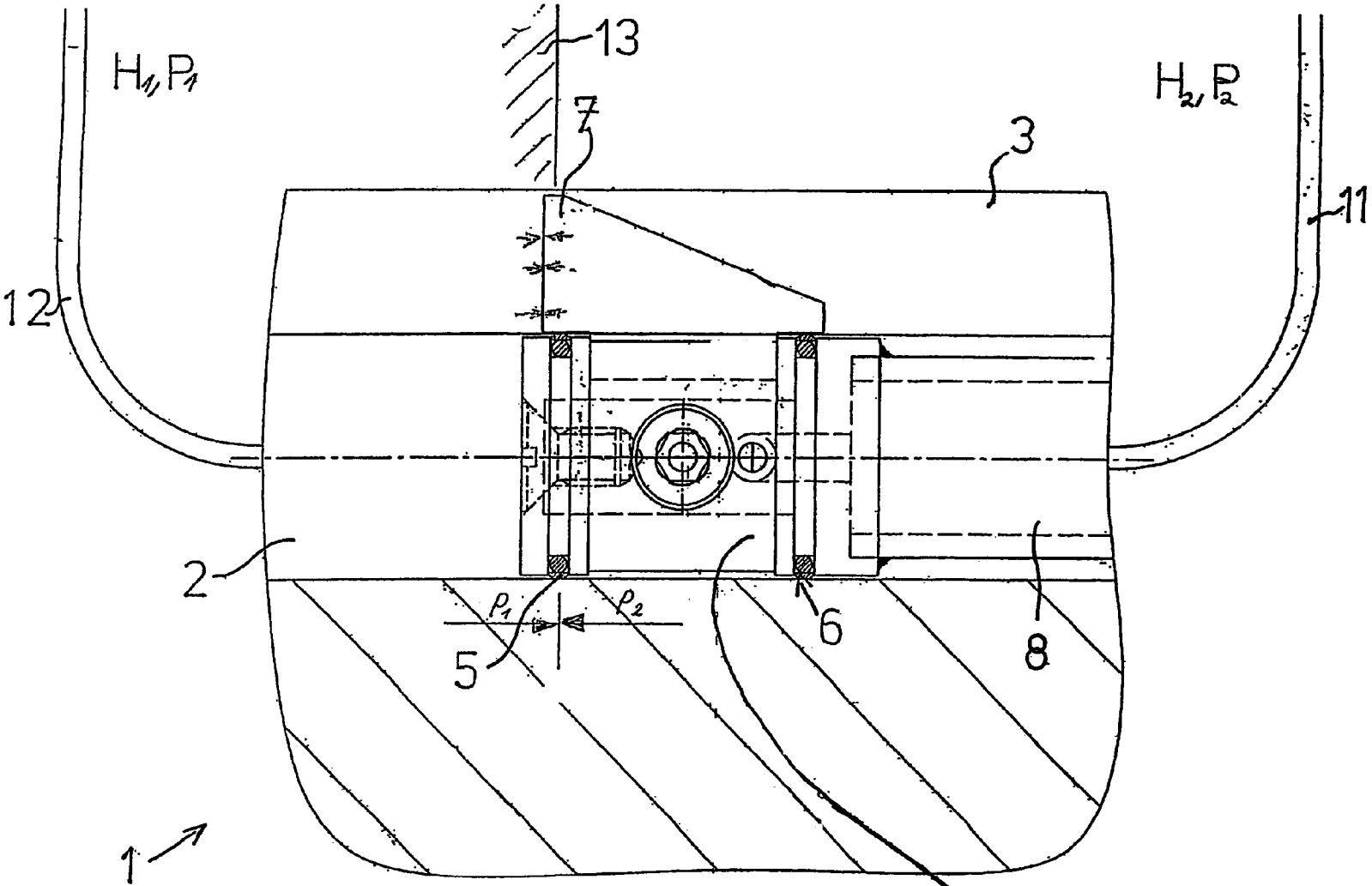

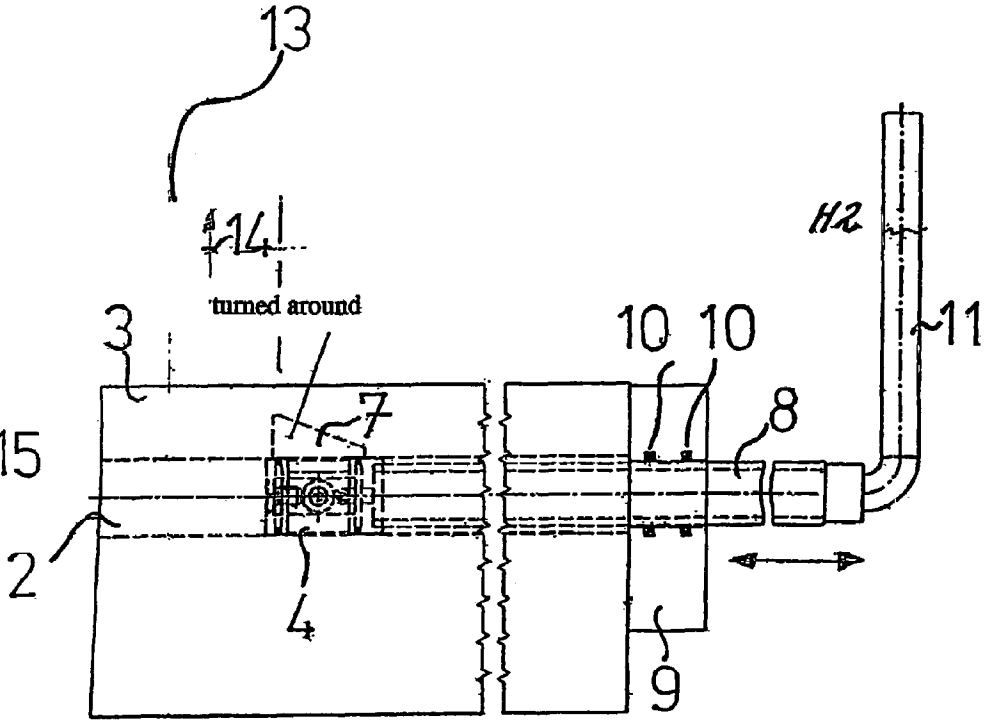
FIG.2b
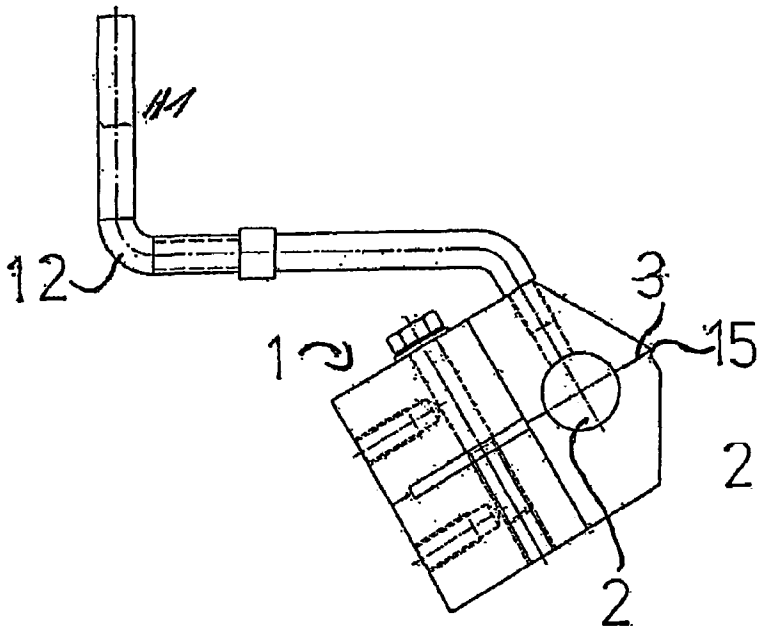
FIG.2a
FIG.2

DEVICE AND METHOD FOR COATING MATERIAL

The present invention relates to a device and a method for coating preferably webs or strip-like materials and in particular to a method and a device for adapting the coating width of such devices. Moreover, the present invention particularly relates to the field of liquid coating using slot coating systems.

There are various prior art systems for adjusting and/or adapting the coating width in coating systems and/or devices. DE-C-195 46 260, e.g., describes a method for monitoring the amount of moisture sprayed on a moving material web across its width. It is proposed therein to measure the local droplet flow of the sprayed liquid for individual measurement areas, to store the measured values of the local droplet flow as set values and to measure the local droplet flow of the sprayed-liquid again and to compare the values with the previously determined set values of the associated measurement areas so as to simply and reliably monitor the sprayed liquid across the width and recognise errors at an early stage.

DE-T-693 26 056 discloses a curtain coating apparatus with edge removal in which a lubricating liquid layer and/or the edge of the curtain in a curtain coating operation are/is removed very abruptly and efficiently in that the lubricating liquid and, optionally, an adjacent narrow section of the curtain fall onto a solid blade. The lubricating liquid and curtain which impinge on the blade are then vacuumed away. This allows the remaining curtain to coat with little or no reduction in velocity due to the removal of the edge band of the falling curtain.

DE-A-42 28 177 relates to an apparatus for continuously applying a liquid to a material web, the apparatus comprising a displaceable screen, troughs situated on both sides of the screen, opposing each other and extending across the screen width, scrapers on both sides of the screen and blowing means consisting of a slot nozzle extending across the screen width which nozzle is connected to a liquid entrainment supply. For steplessly adjusting the liquid application to the width of the material web, each trough is provided with at least one piston that seals off the screen and is steplessly displaceable from one end of the trough and at least one closure strip is allocated to the slot nozzle, which closure strip is steplessly adjustable from one end of the slot nozzle so as to close the slot nozzle more or less.

DE-A-40 01 452 discloses an apparatus for continuously applying a liquid to a material web comprising a displaceable screen, means for filling the screen openings and blowing means for transferring the liquid within the screen openings to the material web. The apparatus is characterised in that the means for filling the screen openings consist of two opposing chambers provided on both sides of the screen and contacting the screen. One of these chambers is a feeding chamber that is connected to a liquid supply, whereas the other chamber is a draining chamber that is connected to a liquid outlet.

EP-A-0 056 067 discloses an apparatus for applying a thin layer of a coating material to a moving material strip, comprising a slot nozzle device with fixed inlet and outlet lips of the jet nozzle slot, the outlet lip being formed as a rotatable doctor rod in a two-part doctor bearing. In order to make the use and/or change of specific counter-pressure rollers over which the material strip is moved superfluous for different material strip widths and to ensure coating-material-free ends of the counter-pressure rollers even in case of elongated production periods over several days, the doctor rod is provided outside the strip width with segment-shaped openings and is driven in an oscillatory way so as to prevent the segment-shaped openings from coming into communication with the slots between the two parts of the doctor bearing.

A problem involved with the prior art systems consists in adapting the coating width to the changing widths of the products to be coated. In particular, a size adaptation is not possible during plant operation. Moreover, an adaptation of the coating width to the product to be coated frequently has a negative effect on the coating, which has to be uniform up to the edge of the product or material web. A high consumption of coating material, which is applied far beyond the width of the product to be coated by the coating system, is to be avoided. Likewise, too low a coating width leading to a non-uniform coating, in particular at the edges of the material web, has to be prevented. Moreover or additionally, the prior art devices and methods are disadvantageous in that the unused outer portions of the device or slot nozzle may be soiled. Solvent-containing coating solutions frequently lead to incrustation or soiling of the unused area. Further disadvantages of the known systems and methods often consist in an insufficient variability of the working width, complex steps to adapt the working width as well as the lacking or insufficient possibility of adapting the slot nozzle width to a material web edge, e.g., if the material runs off centre within the plant.

In the following, the term "width" essentially relates to the width of the coating to be applied or the width of the material to be coated and thus corresponds to the length or effective length of the slot nozzle, which should not be confused with the width of the slot nozzle or the coating slot.

It is an object of the present invention to provide a device and a method overcoming the problems and disadvantages of the prior art. Moreover or additionally, it is the object of the present invention to provide a device and a method ensuring an improved adaptation of the coating width to changing widths of the products to be coated, such a size adaptation being in particular possible during plant operation without any problems. Moreover, it is an object of the present invention to provide a device and a method ensuring a uniform coating up to the edge of the material web. In particular, soiling of the unused peripheral portions of the slot nozzle and/or the coating system are to be avoided. It is a further-object to provide a high quality, economical and easily handleable method or device.

This/these object(s) is/are achieved by a device and/or method according to the claims. In particular, a basic idea of the present invention consists in providing a device and/or method with which the coating width is adjustable via limiting means that are movable with respect to each other. According to an additional or further preferred embodiment of the present invention, the coating width is limited by means of a confining fluid. With the confining fluid, a continuous web material is preferably simulated in the edge area.

A device for adapting the coating width preferably comprises a distribution chamber having a coating slot, the coating material being applied via the distribution chamber through the coating slot onto the material to be coated. Moreover, the device preferably comprises at least one piston that is displaceable within the device, preferably within the distribution chamber. This piston is preferably designed so as to seal off the device or the outer walls of the distribution chamber. Thus, the spreading or distribution of the coating material within the device or the distribution chamber towards the piston is limited by the latter. If the piston is moved within the device or the distribution chamber, the width or spreading of the coating material in the device changes, which has an influence on the coating width.

Moreover, the device is preferably provided with at least one sealing sheet which is arranged at the piston such that it extends from the piston into the coating slot. Thus, the spreading of coating material in the coating slot is limited, preferably in accordance with the aforementioned distribution within the distribution chamber. The sealing sheet is preferably only slightly thinner or less wide than the coating slot.

Preferably, the device is provided with two pistons as described above as well as two sealing sheets that oppose each other so that the coating width may be varied on both sides.

Preferably, the piston may be positioned via a piston rod extending outwards from the device or the distribution chamber and locked in a specific position.

In a further preferred embodiment, the device is supplied with a confining fluid that effects a limitation of the lateral distribution of the coating material or assists in limiting it and thus enables an adaptation of the coating width. Preferably, a confining fluid is used in combination with the aforementioned method or device. The piston is preferably provided with two spaced-apart sealing elements that seal off the piston against the distribution chamber. Preferably, the confining fluid is supplied between the seals so that its distribution within the device or the distribution chamber is laterally limited by the seals. The coating slot is not sealed off so that the confining fluid passes through the coating slot. Preferably, the confining fluid is led along the sealing sheets through the coating slot. Thus, the confining fluid prevents the coating material from laterally distributing within the coating slot or between the coating slot and the sealing sheet. The coating material is thus prevented from spreading into unused areas of the device, the distribution chamber and/or the coating slot. Moreover, the confining fluid prevents the layer from being torn, the formation of strips and/or the coating from spreading in the peripheral portion of the coating width. Preferably, a wider coating or a continuous material web is simulated by the confining fluid.

Preferably, the pressure of the confining fluid and in particular the pressure difference between confining fluid and coating material is adjustable so as to effect an exact and advantageous adaptation of the coating width. Moreover, the pressure in the confining fluid system is adapted to the static pressure within the device or the distribution chamber.

The method and the device according to the invention are designed in accordance with the aforementioned features. The method and the device according to the invention are particularly suitable for the size width adaptation of coating systems, in particular for the coating of web-shaped materials with aqueous solutions and preferably for use in the field of slot coating. Moreover, the described device and method are preferably suitable for liquid coating a preferably specifically prepared aluminium sheet with solvent-containing or aqueous photosensitive coating solutions. Such coatings are preferably applied in a partial process in a coil coating plant that conveys a continuous aluminium sheet through the most different chemical, electrochemical, thermal and/or mechanical processes. The respective finished products are offset printing plates that are adapted to a customised size. Moreover, the described device and method may be used for all slot coating systems for coating with aqueous solutions in coil coating plants.

In the following, a preferred embodiment of the present invention will be described in more detail with reference to the drawings, in which:

FIG. 1 shows a partial section of a device according to the invention for size adaptation by means of a confining fluid for coating systems; and FIG. 2 shows a partial section of a device according to FIG. 1, FIG. 2*a* showing a side view of the device according to the invention and FIG. 2*b* showing a top view of the device according to the invention.

FIG. 1 shows a partial view of a device for adapting the coating width 1 comprising a distribution chamber 2 and a coating slot 3. The distribution chamber 2 comprises a piston 4 which is sealed off against the distribution chamber 2 by seals 5 and 6. Moreover, the piston 4 is provided with a sealing sheet 7 that extends into the coating slot 3.

Preferably, the distribution chamber 2 has a round design so that the chamber is simply laterally sealed off by the piston by means of known and/or piston-shaped seals or sealing means 5, 6.

The coating slot 3, which has a width that corresponds to the requirements and preferably of about 100 μm to about 250 μm, is sealed off by means of a sealing sheet 7 provided at the piston 4. The sealing sheet 7 is thinner than the coating slot or has a lower width or thickness. The sealing sheet 7 is preferably made of special steel, plastics or a material that is resistant to the coating material or solution. Preferably, the sealing sheet 7 is arranged at the piston 4 by clamping it via two shells (not shown) between the seals 5, 6. As shown in FIG. 1, the sealing sheet 7 is preferably essentially triangular.

Preferably, the device is provided with two pistons 4 each comprising a sealing sheet 7 and being arranged displaceably opposite the other, each of the piston rods 8 extending outwards through the distribution chamber 2. Thus, the effective area of the distribution chamber 2 via which the coating material is supplied through the coating slot 3 to a material to be coated extends between the two pistons 4, the unused area of the distribution chamber 2 extending outwardly starting at each piston 4, i.e. away from the effective area. Preferably, the unused area of the distribution chamber 2 is sealed off by the piston rod seals 10 to the right and left or at the outer ends of the coating head or the device 1 via a sealing plate 9 (FIG. 2).

In a preferred embodiment, the pistons or piston rods 8 are shifted or adjusted without being rotated by means of a quick-change attachment (not shown) via a linear unit (not shown) below the receptacle crosshead (not shown) of the device 1, preferably either manually and/or by means of a positioning system (such as an electromotor).

Preferably, a confining fluid is applied to the piston 4 between the seals or sealing means 5, 6. The confining liquid is supplied to the piston rod heads or the pistons 4 via the piston rods 8 via a feeding conduct 11. The confining fluid supplied via the feeding conduct 11 through the piston rod 8 to the piston 4 passes out of the latter between the seals or sealing means 5, 6. The confining fluid preferably fills the space between the piston 4 and the distribution chamber 2 between the seals 5, 6 and escapes along the sealing sheet 7 through the coating slot 3. The pressure of the confining fluid may be adjusted in different known ways. Preferably, the pressure of the confining fluid is adjusted via a dam (not shown) whose height $H_2$ is adjustable. The confining fluid is preferably supplied by means of a dosage pump or a dropping system (not shown). The pressure within the confining system is preferably adapted to the static pressure within the distribution chamber 2. The suitable pressure within the confining system is preferably ascertained in trials or by means of a transparent model.

The coating material is preferably supplied via supply means 12 to the middle effective area of the distribution chamber 2. The pressure of the coating material may be adapted via various known methods and devices. Preferably, the pressure of the coating material is adjusted via a dam (not shown) whose height $H_1$ is adjustable. The coating material is likewise supplied via known systems, preferably via a dosage pump or a dropping system (not shown).

The pressure $P_2$ of the confining fluid effected by the height $H_2$ and the pressure $P_1$ of the coating material effected by the height $H_1$ or their relationship to each other have an influence on the limitation of the coating material and the confining fluid within the slot 3. Here, essentially, if $P_1=P_2$, the coating material and the confining fluid in the slot 3 do not blend. Thus, the confining fluid limits the lateral spreading of the coating material in the slot 3. The lateral spreading of the coating material is consequently restricted by the piston 4, the sealing sheet 7 as well as the confining fluid. Preferably, it is limited in the coating slot 3 to the height of the end of the sealing sheet 7 facing the coating material, as shown in FIG. 1 by the opposing arrows. In the distribution chamber 2, the chamber is sealed off and the lateral spreading of the coating material is limited by the seal or sealing means 5 facing the effective area. The confining fluid is sealed off, i.e. the lateral spreading of the confining fluid is limited by the seals or sealing means 5 and 6.

Preferably, the device 1 is moreover provided with aeration means (not shown).

For coating a material, the device 1 or the distribution chamber 2 is supplied with coating material via the supply means 12 and with confining fluid via the feeding conduct 11, the pistons 4 being positioned according to the width of the material to be coated. The material to be coated 13, whose right edge in terms of the drawing is shown in FIGS. 1 and 2*b*, is passed along the coating device 1, preferably in the direction of the arrow 14, wherein coating material and confining fluid pass out through the coating slot 3 and wherein the coating material is applied to the material to be coated via the coating lip 15 (cf. FIG. 2*a*) that is arranged at the outer end of the coating arrow 3. The piston 4 and sealing sheet 7 and/or the confining fluid prevent the coating material from spreading laterally within the device 1 or the distribution chamber 2 and the coating slot 3, thus avoiding any soiling of the unused areas of the device 1 or the distribution chamber 2 and the coating slot 3 and optimising the amount of coating material used. In particular, the application of confining fluid to the system or the piston 4 between the seals 5, 6 results in that the piston 4 together with the sealing sheet 7 and the outer unused area are free of coating material. Moreover, the confining fluid avoids a soiling or drying-up of the coating system. It is thus moreover avoided that the coating system or the device 1 can no longer be adjusted due to soiling or incrustation or that the sealing sheets 7 tear off or are damaged. Furthermore, soiling of the transport device for the material to be coated, such as an idle roll (not shown) opposite the device 1, in the unused area due to escaping, drying coating material or drying coating solution is prevented.

Moreover, the confining fluid prevents a drop in the layer weight, i.e. the relative amount of coating material towards the edge or laterally. Furthermore, the confining fluid prevents air from being sucked in via the lateral seal(s). Thus, the danger of layer tearing or the formation of strips or air inclusions is reduced, in particular if the weight of the layer is small (less coating material). Due to the application of the confining liquid, a continuous material web or a coating width extending over the width of the material to be coated is simulated in the edge area. The defects and problems particularly in the peripheral areas of a coating are thus avoided while the consumption of coating material is simultaneously reduced. Moreover, the danger that the sealing sheets get soiled is reduced particularly in the event of narrow slots (approx. 20 μm).

The device and the method according to the invention are particularly suitable for coating material webs with aqueous solutions. The maximum working width of the coating system admitting, e.g., a maximum product width of approx. 1700 mm, is adaptable to smaller widths, such as 1250 mm or less, without any problems. Preferably, the working width is variable in a range of 500 mm to 1600 mm. The function of the method and/or the device allow for by far larger or smaller widths than those mentioned above. Moreover, the system is adaptable to a varying edge of the material web and capable of tracking the edge of the material web, e.g., if the material runs off centre, in particular sideways.

Preferably, a coating solution, preferably an aqueous solution (mostly clean solutions, solvents), is used as coating material. The type of confining fluid to be used depends on the coating solution. The consumption of confining fluid or purifier is preferably in a range of 0.25% to 10% and preferably of about 0.5% to 2% of the coating solution. Preferably, the confining fluid comprises a component of the coating solution and/or particularly preferably, e.g., methanol.

The described method as well as the described device are particularly suitable for heavy-duty plants with frequently changing products and product widths. The device and the method according to the invention allow for a high-quality, economical and easily handleable coating, particularly of products with changing widths, while the disadvantages of the prior art discussed in the introductory portion are overcome.

The invention claimed is:

1. A device for adapting coating width of a coating system, comprising a distribution chamber in fluid communication with a coating slot for supplying a coating fluid of a given width onto a substrate, and at least one limiting means limiting the width of the coating slot and the distribution chamber for containing a coating fluid, wherein the at least one limiting means comprises a piston comprising a piston head and piston rod, provided with two spaced-apart sealing elements that seal off the piston against the distribution chamber, wherein the at least one limiting means is movable and is adapted for supplying a confining fluid to the piston head through the piston rod, between the sealing elements and through the coating slot for preventing the coating fluid from laterally distributing within the coating slot and for simulating a continuous material web.

2. The device according to claim 1, wherein the piston is provided with a sealing sheet extending into the coating slot.

3. The device according to claim 2, wherein the two sealing elements are positioned approximately at the beginning and the end of the sealing sheet.

4. The device according to claim 1, wherein the coating slot has a width of about 100 μm to about 250 μm.

5. The device according to claim 1, consumption of the confining fluid of about 0.5% to about 2% of the coating fluid used.

6. The device according to claim 1, wherein the confining fluid comprises an aqueous solution.

* * * * *